US009224562B2

(12) United States Patent
Naumann et al.

(10) Patent No.: US 9,224,562 B2
(45) Date of Patent: Dec. 29, 2015

(54) ELECTROMAGNETIC RELAY

(71) Applicants: ELLENBERGER & POENSGEN GMBH, Altdorf (DE); CERAM TEC GMBH, Plochingen (DE)

(72) Inventors: Michael Naumann, Feucht (DE); Reiner Bindig, Bindlach (DE); Alfons Kelnberger, Bamberg (DE); Hans-Juergen Schreiner, Hersbruck (DE); Peter Stingl, Lauf (DE); Peter Meckler, Hohenstadt/Pommelsbrunn (DE); Markus Birner, Zirndorf (DE)

(73) Assignees: ELLENBERGER & POENSGEN GMBH, Altdorf (DE); CERAM TEC GMBH, Plochingen (DE)

( * ) Notice: Subject to any disclaimer, the term of this patent is extended or adjusted under 35 U.S.C. 154(b) by 0 days.

(21) Appl. No.: 14/167,550

(22) Filed: Jan. 29, 2014

(65) Prior Publication Data

US 2014/0145803 A1 May 29, 2014

Related U.S. Application Data

(63) Continuation of application No. PCT/EP2012/002586, filed on Jun. 20, 2012.

(30) Foreign Application Priority Data

Jul. 29, 2011 (DE) ..... 10 2011 108 949

(51) Int. Cl.

| | |
|---|---|
| ***H01H 51/22*** | (2006.01) |
| ***H01H 51/12*** | (2006.01) |
| ***H01H 57/00*** | (2006.01) |

(Continued)

(52) U.S. Cl.

CPC ..... *H01H 51/12* (2013.01); *H01H 47/04* (2013.01); *H01H 50/32* (2013.01); *H01H 57/00* (2013.01); *H01H 50/26* (2013.01); *H01H 50/646* (2013.01); *H01H 51/082* (2013.01); *H01H 71/127* (2013.01); *H01H 2057/003* (2013.01)

(58) Field of Classification Search

USPC ..... 335/78

See application file for complete search history.

(56) References Cited

U.S. PATENT DOCUMENTS 4,382,243 A * 5/1983 Babitzka et al. ..... 335/219
4,458,171 A 7/1984 Kolm et al.

(Continued)

FOREIGN PATENT DOCUMENTS

DE 3300717 A1 8/1983
DE 3603020 A1 8/1987

(Continued)

OTHER PUBLICATIONS

International Search Report of PCT/EP2012/002586, Filed Nov. 6, 2012.

*Primary Examiner* — Alexander Talpalatski
(74) *Attorney, Agent, or Firm* — Laurence Greenberg; Werner Stemer; Ralph Locher

(57) ABSTRACT

An electromagnetic relay, in particular a motor vehicle relay, contains a magnet yoke, a relay coil, a hinged armature which is pivotable about an axis of rotation and on which a moving contact, as working or switchover contact, is retained relative to at least one fixed contact. A piezo actuator is provided, which keeps the working or switchover contact closed when the relay coil is de-energized as a result of the actuation of the piezo actuator.

15 Claims, 6 Drawing Sheets

(51) Int. Cl.

| | |
|---|---|
| ***H01H 47/04*** | (2006.01) |
| ***H01H 50/32*** | (2006.01) |
| *H01H 50/26* | (2006.01) |
| *H01H 50/64* | (2006.01) |
| *H01H 51/08* | (2006.01) |
| *H01H 71/12* | (2006.01) |

(56) References Cited

U.S. PATENT DOCUMENTS

| | | | | |
|---|---|---|---|---|
| 4,654,553 | A | 3/1987 | Sato et al. | |
| 4,689,516 | A * | 8/1987 | Yokoyama et al. | 310/317 |
| 5,040,567 | A * | 8/1991 | Nestler et al. | 137/625.44 |
| 5,093,600 | A | 3/1992 | Kohl | |
| 6,091,314 | A * | 7/2000 | Wright et al. | 335/220 |
| 7,944,332 | B2 * | 5/2011 | Hilgers | 335/78 |
| 8,040,654 | B2 | 10/2011 | Lenz | |
| 8,520,356 | B2 | 8/2013 | Lenz | |
| 2002/0039060 | A1 * | 4/2002 | Maruyama | 335/220 |
| 2004/0169988 | A1 * | 9/2004 | Leiber | 361/160 |
| 2005/0093666 | A1 * | 5/2005 | Miyajima et al. | 335/285 |
| 2005/0104699 | A1 | 5/2005 | Bataille et al. | |
| 2006/0181380 | A1 * | 8/2006 | Nakamura et al. | 335/132 |

FOREIGN PATENT DOCUMENTS

| | | | |
|---|---|---|---|
| DE | 4118177 | A1 | 12/1992 |
| DE | 9212266 | U1 | 3/1993 |
| DE | 4410819 | A1 | 9/1994 |
| DE | 4325619 | A1 | 2/1995 |
| DE | 4418177 | A1 | 11/1995 |
| DE | 19813128 | A1 | 9/1999 |
| DE | 102005037410 | A1 | 2/2007 |
| DE | 102006018669 | A1 | 7/2007 |
| DE | 102008023626 | A1 | 11/2009 |
| EP | 0175387 | A2 | 3/1986 |
| WO | 8902659 | A1 | 3/1989 |
| WO | 2004051684 | A1 | 6/2004 |
| WO | 2005001868 | A1 | 1/2005 |

* cited by examiner

ELECTROMAGNETIC RELAY

CROSS-REFERENCE TO RELATED APPLICATION

This is a continuation application, under 35 U.S.C. §120, of copending international application No. PCT/EP2012/002586, filed Jun. 20, 2012, which designated the United States; this application also claims the priority, under 35 U.S.C. §119, of German patent application No. DE 10 2011 108 949.0, filed Jul. 29, 2011; the prior applications are herewith incorporated by reference in their entireties.

BACKGROUND OF THE INVENTION

Field of the Invention

The invention relates to an electromagnetic relay, in particular a motor vehicle relay, containing a magnet yoke, a relay coil and also a hinged armature which can be pivoted about a rotation axis and on which a moving contact, as an operating or switchover contact, is held relative to at least a first fixed contact.

A relay, as also used in many instances as an electromagnetic switch in a motor vehicle in particular, is activated by a control circuit in which the relay coil is situated and usually switches at least one further circuit in which, for example, an electric motor, a gasoline pump or often also safety-relevant vehicle components, for example a fuel injection system, are connected.

In principle, a distinction is drawn between monostable and bistable relays. A monostable relay requires a permanent flow of current through the relay coil (field winding) in order to pull in and also to hold the armature, for the purpose of assuming and maintaining the operating position (ON). If the flow of current is interrupted, the relay autonomously returns to its inoperative position (OFF). A bistable relay can have two different stable states in the de-energized state, and therefore, when a current pulse is generated in the control circuit, it switches over to the respectively other switching state and maintains this switching state until the next control pulse. The bistable relay therefore has to be actively actuated in order to reach a defined switching position.

Relays which have as low a power as possible and can be actuated in a power-saving manner are desired or required particularly in the motor vehicle sector, especially since power losses and in particular permanent losses result in correspondingly elevated $CO_2$ emissions by the motor vehicle.

In order to provide low-power relays, published, non-prosecuted German patent application DE 43 25 619 A1 discloses connecting two relays in parallel in a first phase, in which a comparatively large pull-in voltage for the armature is required, and, after the operating circuit contact is closed, connecting the two relays in series in a second phase in which only a comparatively low holding voltage is required.

In a relay which is known from published, non-prosecuted German patent application DE 44 10 819 A1, a switch bridges a holding resistor which adjusts the holding current of the field winding of the relay. As a result of the resistor being bridged, a comparatively large pull-in current is available at the first moment at which the field winding is connected.

Published, non-prosecuted German application DE 10 2005 037 410 A1 discloses reducing the voltage supply to a minimum, which holds the working contact, in the field circuit by a microcontroller after the relay has been pulled in.

In a relay which is known from published, non-prosecuted German patent application DE 10 2008 023 626 A1 (corresponding to U.S. Pat. Nos. 8,520,356 and 8,040,654), when the relay is supplied with current by a switch, the relay controller is configured to control the field current in such a way that a pull-in current initially flows through the field winding and, after a pull-in time has elapsed, a holding current which is smaller than the pull-in current flows through the field winding.

It is also known, for example from German utility patent DE 92 12 266 U1, to reduce the power loss in the relay coil by pulse-width modulation of the coil current following the pull-in time when a relay is controlled.

SUMMARY OF THE INVENTION

The invention is based on the object of specifying an electromagnetic relay, which is suitable preferably as a motor vehicle relay, which operates with as low a power as possible, in particular in the holding mode (ON).

To this end, the relay points a moving or switchover contact and therefore forms a hybrid system with monostable behavior with only a very low level of current consumption. When the field winding is de-energized, the moving or switchover contact is held closed by the piezo actuator, preferably indirectly by the hinged armature against which the moving contact bears in a spring-prestressed manner in the form of a spring contact.

Therefore, although the relay according to the invention is comparable to a bistable system according to the principle of the holding mode, the relay coil or field winding is de-energized in the holding mode, in contrast to a conventional monostable relay. The piezo actuator requires a brief flow of current only when it is actuated, whereas a voltage only has to be applied following this brief flow of current given an only very small leakage current (holding mode). Since the piezo actuator therefore operates virtually without power and the relay coil is de-energized, the relay according to the invention likewise operates virtually without power in the holding mode.

The hybrid piezo relay system which is provided as a result is particularly suitable for reliable switching. The monostable behavior ensures that the piezo relay leads to a defined state in a reliable and autonomous manner in the event of a loss of voltage, in particular in the event of a loss of the on-board electrical system voltage of a motor vehicle. Since the piezo actuator only maintains the contact closure for as long as the actuation voltage of the piezo actuator is supplied in the holding mode and when the relay coil is de-energized, the contact opens spontaneously in the event of a loss of the actuation voltage as a result of the loss of the supply or on-board electrical system voltage.

On account of the holding or inoperative state which is maintained virtually without power, the relay according to the invention is extremely advantageous, particularly in the motor vehicle sector, since the low power loss is accompanied by a corresponding $CO_2$ saving by the motor vehicle. In addition, the temperature development of the relay coil of the hybrid piezo relay system according to the invention, that is to say the operating temperature, is considerably lower than in conventional relays and is approximately room temperature. This provides the considerable advantage of a particularly flexible and variable design of the installation space for the piezo relay.

Although it is known, in principle, to equip a relay with a piezo actuator (piezoelectric elongator), a piezo actuator, which is configured in particular as a piezoelectric bending transducer, replaces the field winding or coil and acts directly on the operative contact in the case of the relays, as are known, for example, from German patent DE 36 03 020 C2, from international patent disclosure WO 89/02659 (corresponding to U.S. Pat. No. 5,093,600), from published, non-prosecuted German patent application DE 198 13 128 A1 or published, non-prosecuted German patent application DE 10 2006 018 669 A1.

A piezo actuator which acts on the hinged armature with direct mechanical contact is also used in a residual current release which is known from published, non-prosecuted German patent application DE 41 18 177 A1. However, in addition or as an alternative to a field winding which surrounds the pole limb of a U-shaped magnet yoke, the piezo actuator serves to lift off the hinged armature from the pole surface, in order to assist a mechanical return spring, which acts on the hinged armature, to overcome an undesired adhesion force.

The piezo actuator of the relay according to the invention is preferably configured as a (piezo) stack actuator (stack), the force stroke direction of which runs parallel to the rotation axis of the hinged armature. In order to increase the force stroke which is generated by the piezo actuator as a result of being actuated, a lever transmission device is suitably provided, the lever transmission device converts the force stroke into a clamping stroke for releasable fixing a tension element which is held on the hinged armature or moving contact side. The transmission ratio is suitably 2:1, so that a force stroke of the piezo actuator of, for example ≥15 μm leads to a clamping stroke of ≥30 μm.

In an advantageous refinement, the tension element, which is held on one side of the hinged armature or moving contact (changeover or switchover contact), is routed by way of its free side into a clamping gap and held there in a force-fitting manner as a result of the piezo actuator being actuated.

The clamping gap is preferably provided on the magnet yoke. To this end, a slot, which is produced by a material cutout and which runs radially in relation to the relay coil and is interrupted or closed at a suitable point by a narrow web which is formed by the magnet yoke material, is provided in the pole limb, which is parallel to the hinged armature, of the suitably L-shaped magnet yoke. As a result, starting from a rotation or tilting point, which is formed by the material web, a lever arm which is acted on by the piezo actuator is formed in the direction of the piezo actuator and a clamping arm of a clamping lever which pivots about the rotation point is formed in the other direction toward the clamping gap. In this case, the length of the clamping arm is preferably greater than, preferably at least twice the size of, the length of the lever arm.

In the mounted state, the piezo actuator which acts on the clamping lever is supported on a supporting limb, the distance of the supporting limb from the clamping lever being matched to the height of the piezo actuator. An axial functional limb, which runs at a right angle to the radial pole limb and which preferably has a U-shaped receiving pocket for the piezo actuator, is provided relative to the relay coil. The U-limbs, which are parallel to one another, merge with the supporting limb and, respectively, with the clamping limb of the pole limb.

The hinged armature is connected in an articulated manner to the functional limb by means of the rotation axis. In addition, a magnet core, which is surrounded by the field winding, of the relay coil is ideally routed on one side toward the hinged armature and fastened, for example riveted, on the other side to the magnet yoke, that is to say to the pole limb which is situated opposite the hinged armature.

In order to reliably prevent the tension element from sliding (radially) out of the open clamping gap, the clamping gap is formed by a bead-like clamping groove in which the tension element is securely situated. A clamping cam which engages in the clamping groove is expediently provided on the clamping lever, whereas the clamping groove is then located on the remaining pole limb of the magnet yoke on the opposite gap side.

The moving contact is preferably configured as a spring contact for generating a spring return force which acts on the hinged armature. To this end, an approximately L-shaped spring element is suitably bent or shaped, wherein one of the offset spring limbs is fixed to the functional limb of the magnet yoke, and the further spring limb is fixed to the hinged armature.

Since, as is known, the piezo actuator behaves in a similar manner to a capacitor in the event of current consumption, a flow of current is required firstly only at the moment at which the clamping force is generated. Secondly, in order to reliably release the clamping in the event of a loss of the control voltage for actuating the piezo actuator, the piezo actuator is connected in parallel with a suitable non-reactive resistor. This ensures that the relay reliably moves to the pre specified state, in particular by correspondingly reliable opening of the operative contact or by a contact changeover in the case of a switchover contact.

The components of the relay according to the invention are preferably assembled in a reliably sealed manner in a relay housing which is formed from a device base and a housing cap. In this case, both the relay coil and also the piezo actuator have an associated, preferably common, control electronics system within the housing. Operating or switchover contacts and also the control contacts for the electronics system are routed out of the housing base in the form of flat plug connections. The connections of the piezo actuator are connected to the electronics system within the housing.

Other features which are considered as characteristic for the invention are set forth in the appended claims.

Although the invention is illustrated and described herein as embodied in a electromagnetic relay, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
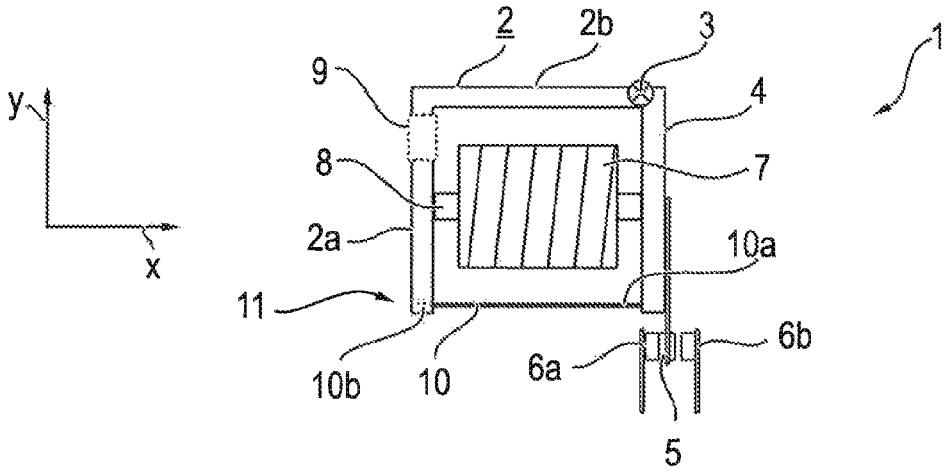
FIG. 1 is a schematic showing an electromagnetic relay containing a relay coil in a magnet yoke with a hinged armature, which can be pivoted on the magnet yoke, and a piezo actuator which keeps an operating or switchover contact closed by a tension element when a field winding is de-energized.

Parts which correspond to one another are provided with the same reference symbols throughout the figures. Referring now to the figures of the drawing in detail and first, particularly, to FIG. 1 thereof, there is schematically shown a relay 1 containing a magnet yoke 2 with a hinged armature 4 which can be pivoted about a rotation axis 3 on the magnet yoke 2 and on which a moving contact 5 is held. The moving contact 5 is in the closed position with a fixed contact (inoperative contact) 6*a*, and in the open position to a further fixed contact (operative contact) 6*b*, so that a changeover or switchover contact is formed overall.

A relay coil 7, which is also called a field winding in the text which follows, together with its magnet core 8 is located between the hinged armature 4 and a pole limb 2*a*, which is parallel to the hinged armature, of the L-shaped magnet yoke 2. The magnet core 8 and a functional limb 2*b* of the magnet yoke 2 run in axial direction x in relation to the relay coil 7, whereas the hinged armature 4 and the pole limb 2*a* of the magnet yoke 2 runs in the radial direction y in this respect. A piezo actuator 9 is located in the vicinity of the functional limb 2*b* or the junction between the functional limb and the pole limb 2*a* of the magnet yoke 2. The piezo actuator 9 is configured as a piezo stack actuator (stack).

A tension element 10, which is also called a clamping spring in the text which follows, is located opposite the functional limb 2*b* of the magnet yoke 2, the tension element 10 spanning the open side of the U-shaped magnet yoke 2 and being held on one side on the hinged armature 4 and on the other side on the pole limb 2*a* of the magnet yoke 2. A spring end 10*a*, which is associated with the hinged armature 4, of the tension element 10 is held in a captive manner on the hinged armature 4, whereas the opposite clamping end 10*b* of the tension element 10 is fixed in a clamping manner in a clamping gap 11 (FIG. 2), which is provided in the pole limb 2*a*, when the hinged armature 4 is pulled in and therefore contacts 5, 6*a* are closed. In this state, the relay coil 7 can be controlled without power, without the hinged armature 4 dropping out and accordingly the contact 5, 6*a* opening.

As a result, a hybrid piezo relay system for reliable switching with monostable behavior and an extremely low level of current consumption is provided. Since the relay coil 7 is de-energized in the shown holding mode and the piezo actuator 9 requires only the necessary actuation voltage in order to maintain a clamping force $F_K$, which is generated as a result of the piezo actuator 9 being actuated or voltage being applied to the piezo actuator 9 and which holds the tension element 10 when the armature 4 is pulled in, and the leakage currents in the piezo stack actuator 9 of this kind are extremely low, the contacts 5, 6*a* can be closed virtually without power. This is extremely advantageous, particularly in the motor vehicle sector, since the power loss of a relay with each watt of electrical power is accompanied by a correspondingly elevated $CO_2$ emission by the motor vehicle.

Figure 2:
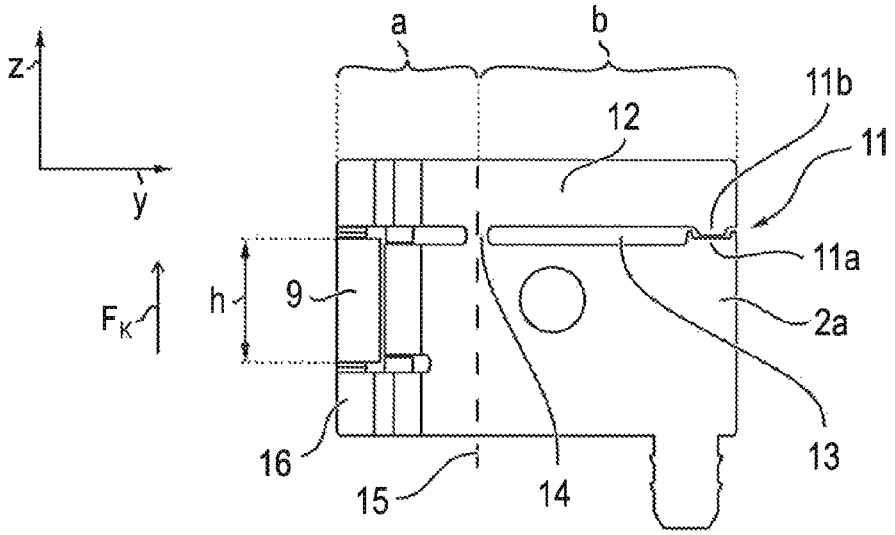
FIG. 2 is a diagrammatic, side view of a detail of the magnet yoke with a pole limb which is slotted so as to form a clamping lever.

FIG. 2 shows, in a side view of the pole limb 2*a* of the magnet yoke 2, a clamping lever 12 which is formed on the pole limb 2*a* and is formed by a longitudinal slot 13, which runs in the radial direction y, in the pole limb 2*a*. A material web 14, which forms a rotation point about a rotation axis 15 (which is indicated by a dashed line) and virtually locally closes the longitudinal slot 13, is present or remains along the longitudinal slot (material or radial slot) 13. Therefore, a lever arm a is produced between the rotation point or rotation axis 15 and the location of the piezo actuator 9, whereas a clamping arm b is produced between the rotation point 14 and the clamping gap 11. In this case, the clamping arm b is approximately twice as long as the lever arm a ($b \geq 2a$) in the exemplary embodiment.

A supporting limb 16, on which the piezo actuator 9 which operates the clamping lever 12 as a result of being actuated is supported, is inserted into the magnet yoke 2 spaced apart from the clamping lever 12 by the height h, which runs in the z-direction, of the piezo actuator 9. According to the illustrated Cartesian coordinate system, the clamping force $F_K$, which is generated by the piezo actuator 9, and the stroke direction of the clamping force run in the z-direction, whereas the longitudinal slot 13, which forms the clamping lever 12, runs in the radial direction y.

FIG. 2 comparatively clearly also shows the configuration of the clamping gap 11. A clamping groove 11*a*, in which the clamping end 10*b* of the tension element 10 is situated and therefore secured against pivoting out in radial direction y, is made in the pole limb 2*a* of the magnet yoke 2 in the region of the clamping gap 11. A clamping cam 11*b*, which is integrally formed on the clamping lever 12 and there on the free end of the clamping arm b of the clamping lever, engages in the clamping groove 11*a* with the interposition of the clamping end 10*b* of the tension element 10.

Figure 3:
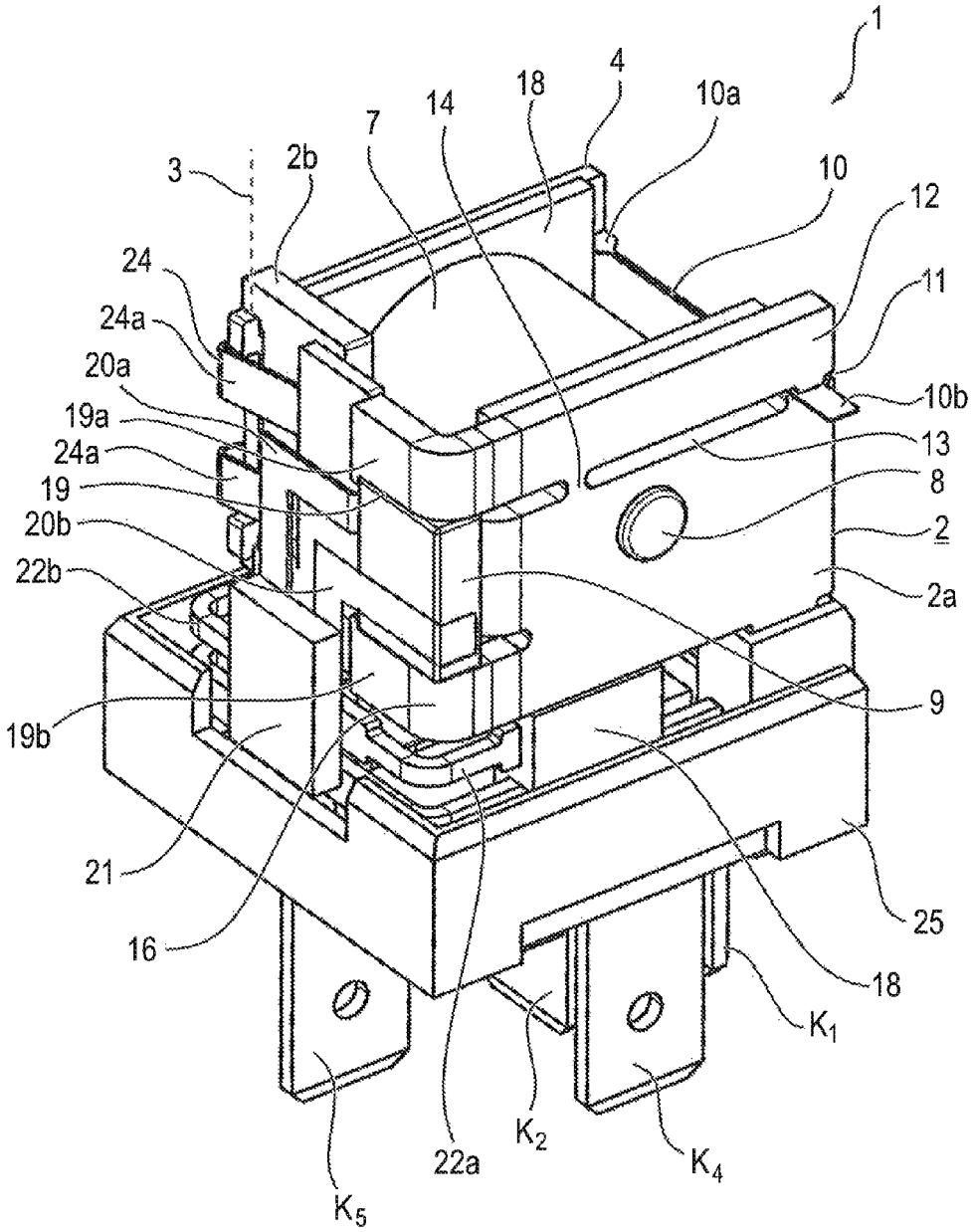
FIG. 3 is a perspective view of a detail of the electromagnetic relay looking at the piezo actuator with the housing open.
Figure 4:
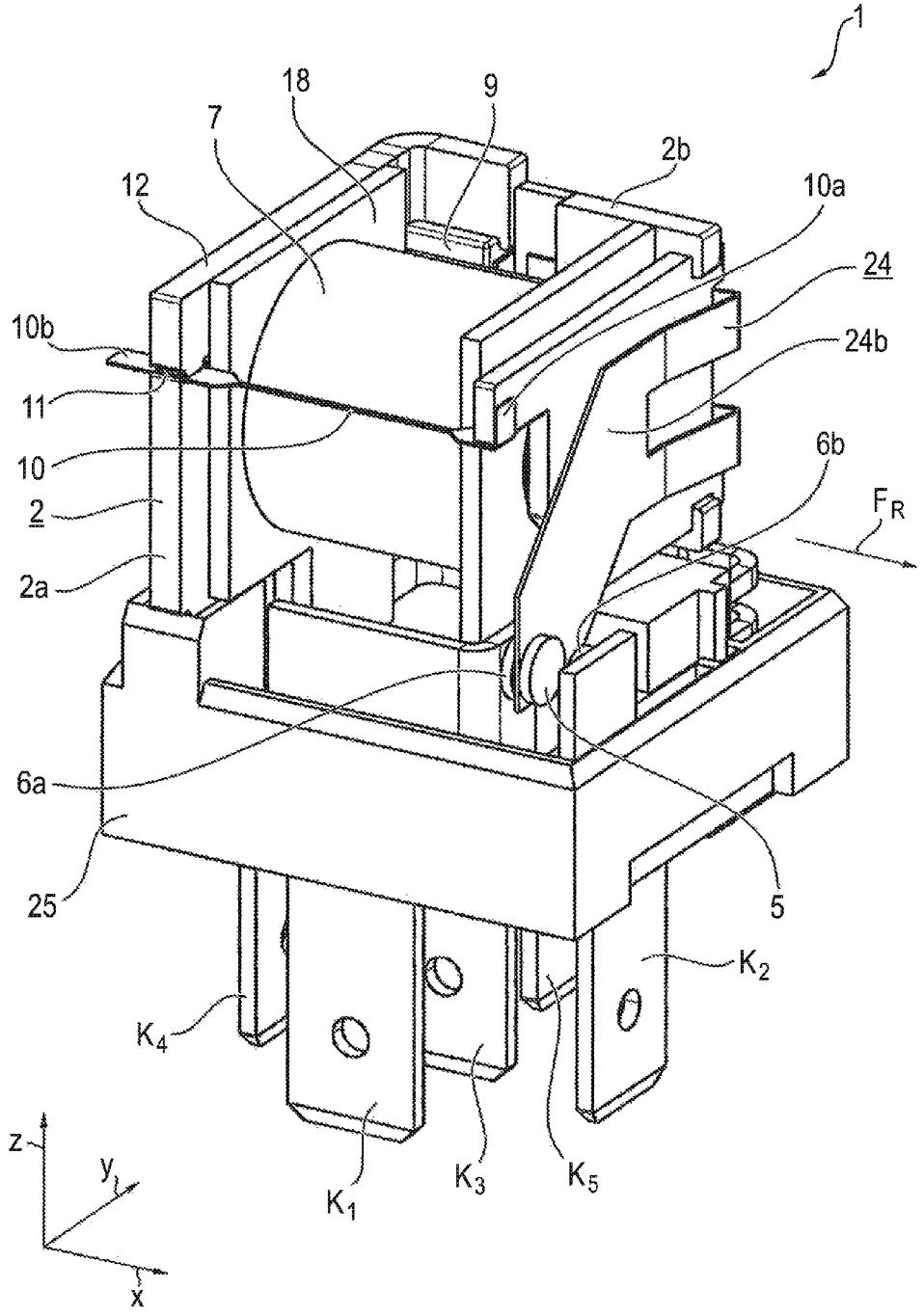
FIG. 4 is a further perspective view of the electromagnetic relay looking at the operating or switchover contact and the tension element.
Figure 5:
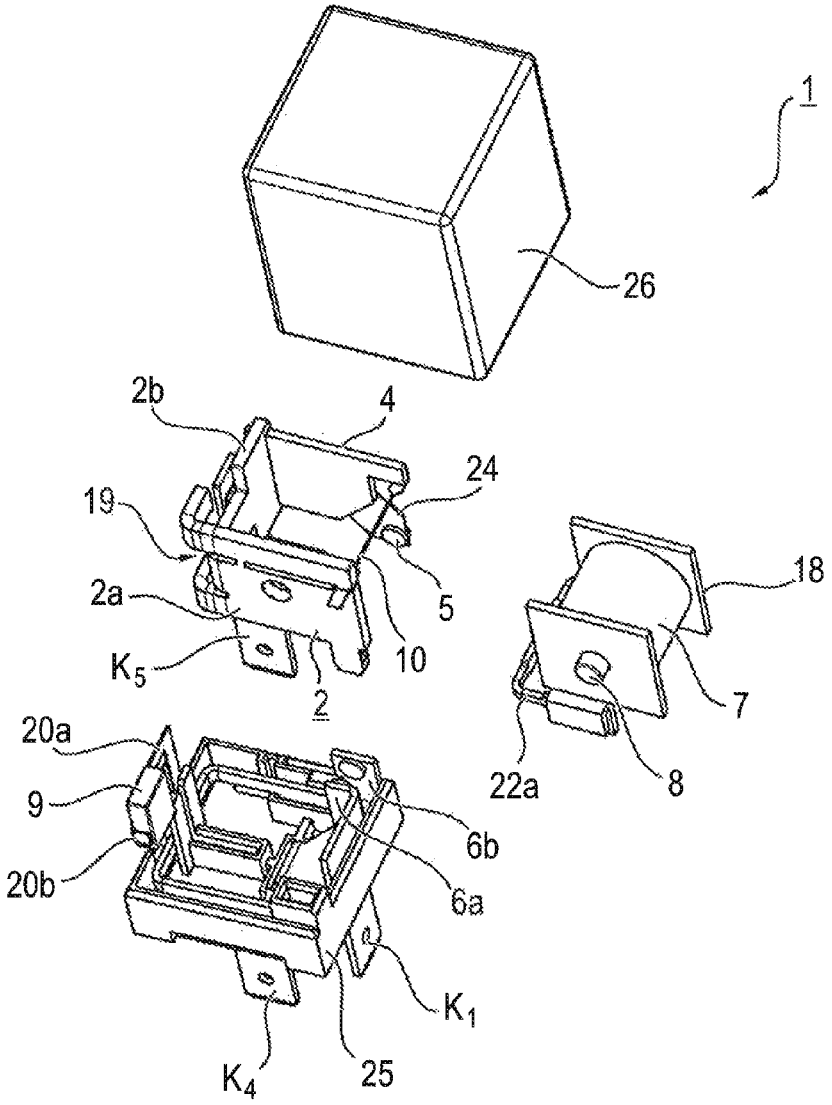
FIG. 5 is an exploded, perspective view of the relay with a housing base partially mounted, a separate yoke and a relay coil and also a housing cap.
Figure 6:
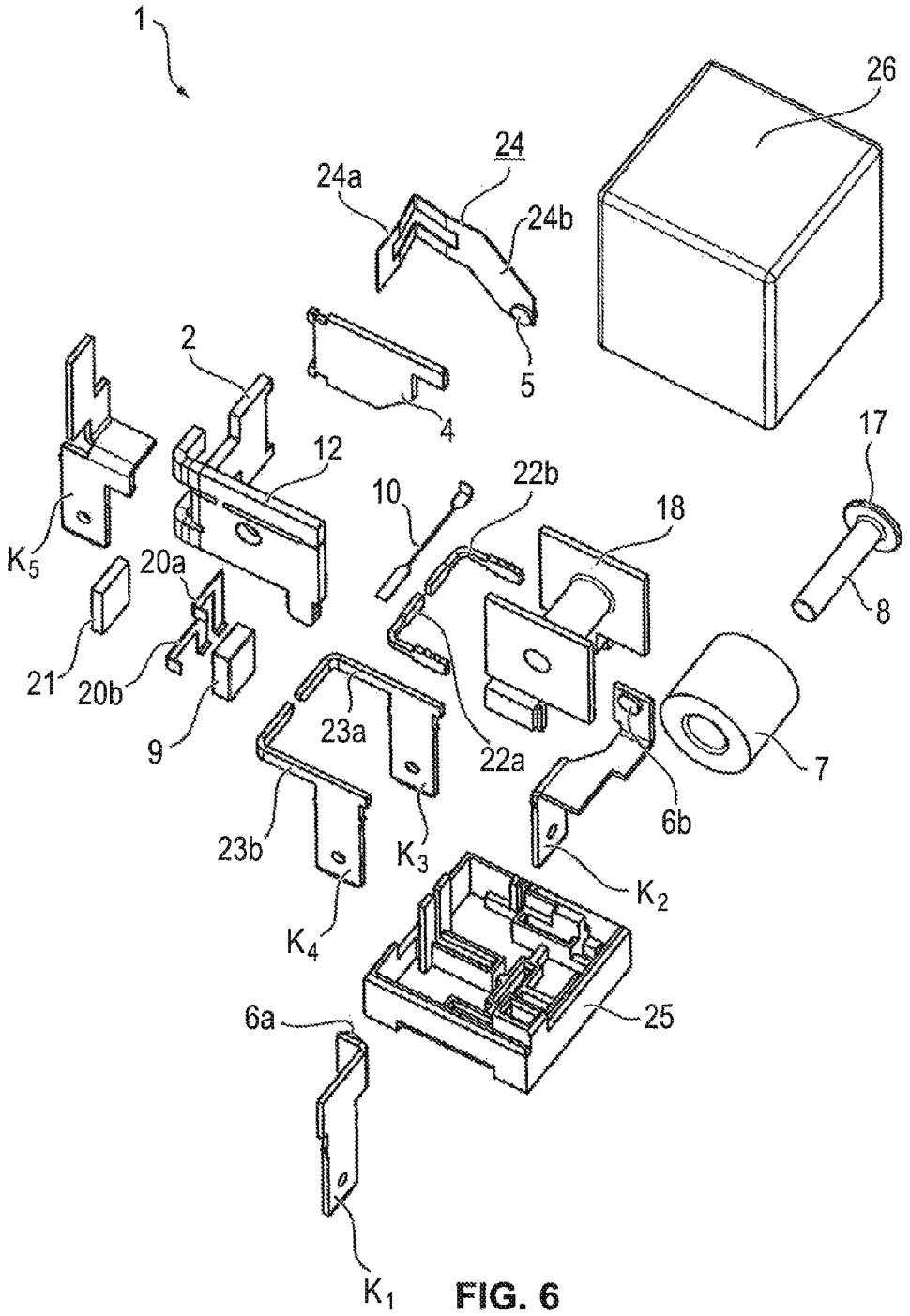
FIG. 6 is a different exploded, perspective view of the relay.

FIGS. 3 to 6 show a preferred embodiment of the relay 1 according to the invention in various perspective views (FIGS. 3 and 4) and also in exploded illustrations of different details (FIGS. 5 and 6).

FIG. 3 comparatively clearly shows the tension element 10 which is situated in the clamping gap 11 and is clamped at its clamping end 10*b*. FIG. 3 also shows the magnet core 8 which is riveted to the pole limb 2*a*, which passes through the relay coil or field winding 7 and is supported (FIG. 4) on a coil former 18 on the armature side by way of a head 17 (FIG. 6).

In order to arrange the piezo actuator 9 in a particularly functional and space-saving manner, a U-shaped receiving pocket 19 is made in the functional limb 2*b* of the magnet yoke 2. U-limbs 19*a* and 19*b*, which are parallel to one another, of the U-shaped receiving pocket merge with the (upper) clamping limb 12 and, respectively, with a (lower) supporting limb 16 of the pole limb 2*a*.

Contact elements 20*a*, 20*b*, which for their part are connected to an electronics system 21 for the purpose of relay control, make contact with the piezo actuator 9. Contact elements 22*a*, 22*b* with which the winding ends of the relay coil 7 make contact (in a manner not illustrated in any detail) are also connected to the electronics system 21. The contact elements 22*a*, 22*b* are fixed in the coil former 18, as shown in FIG. 6. The electronics system 21 is additionally connected to control connections 23*a*, 23*b* which are illustrated in FIG. 6.

As shown comparatively clearly in FIGS. 4 and 6, the moving contact 5 is configured as a spring contact. To this end, an L-shaped spring element 24 has a spring limb 24*a*, which is held on the functional limb 2*b* of the magnet yoke, and also a further spring limb 24*b*, which is routed on the outer face, which is averted from the relay coil 7, of the hinged armature 4 and there is connected to the hinged armature. The spring element 24 and therefore the spring or moving contact 5 creates a return force $F_R$ on the hinged armature 4 in the x-direction, so that the hinged armature drops out in a manner assisted by the corresponding spring force when both the relay coil 7 is de-energized and the piezo actuator 9 is free of voltage and therefore the clamping gap 1 is open.

The illustrated and described components and elements of the relay 1 are mounted on a housing base 25 which, in the final assembled state, is covered by a housing cap 26, preferably in a dirt-tight and moisture-tight manner. Contact connections $K_1$, $K_2$ (operating or inoperative contact connection) of the fixed contacts 6*a* (inoperative contact) and, respectively, 6*b* (operative contact), at least one contact connection $K_3$ (control connection 23*a* and/or 23*b*) of the electronics system 21, at least one contact connection $K_4$ (coil contact connection) of the relay coil 7 and also a contact connection $K_5$ (changeover contact connection) of the moving or changeover or switchover contact 5 are routed out of the bottom of the housing base 25 which has an approximately square cross section.

Figure 7:
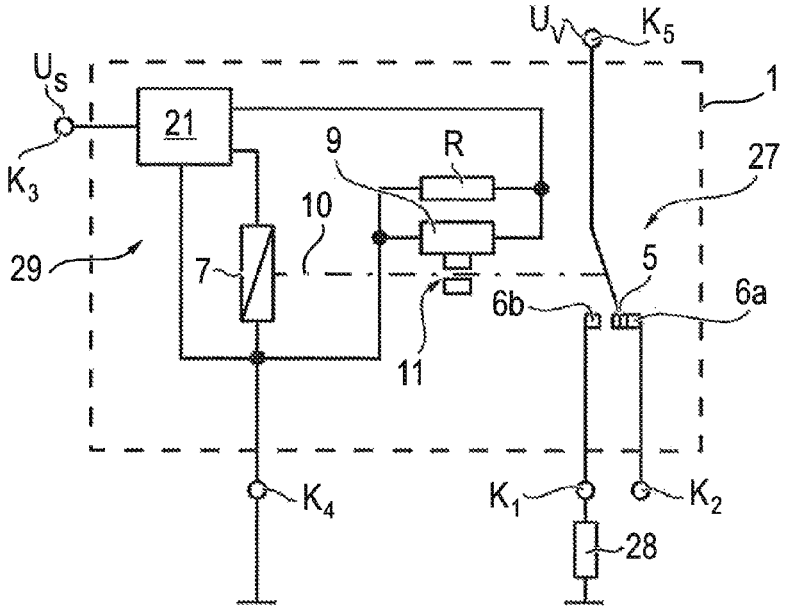
FIG. 7 is a circuit diagram of the electromagnetic relay.

FIG. 7 shows a circuit diagram of the electromagnetic piezo relay 1 according to the invention. A switching circuit or path 27, in which a load 28, for example a gasoline pump or an electric motor, is connected in series with the operative contact 6*b* between the positive pole and the negative pole or ground of a supply voltage $U_V$, is electrically conductively disconnected from a control circuit or path 29 of the relay 1. Whereas FIG. 4 shows the electromagnetic relay 1 in the switched-on state (ON), FIG. 7 shows the switched-off state (OFF).

The electronics system 21 is supplied with a control voltage $U_S$ which, in the case of a motor vehicle, is obtained from the on-board electrical system voltage of the motor vehicle. A non-reactive resistor R is connected electrically in parallel with the piezo actuator 9 in order to reliably break the clamping of the tension element 10 in the clamping gap 11 in the event of a loss of the control voltage $U_S$. In the case of a fault of this kind, the moving contact 5 moves from the shown closed or operating state to the safe changeover state by making contact with the changeover contact 6*b*.

The invention is not restricted to the above-described exemplary embodiment. Rather, other variants of the invention can also be derived from the exemplary embodiment by a person skilled in the art, without departing from the subject matter of the invention. In particular, all of the individual features described in connection with the exemplary embodiment can furthermore also be combined with one another in a different way, without departing from the subject matter of the invention.

The invention claimed is:

1. An electromagnetic relay, comprising:

a magnet yoke having a clamping gap formed therein;

a relay coil;

a moving contact;

a first fixed contact;

a hinged armature being pivotable about a rotation axis and on which said moving contact being held relative to at least said first fixed contact;

a piezo actuator which, as a result of being actuated, keeps said moving contact closed when said relay coil is de-energized;

a tension element having a free side, said tension element being held on one side of said hinged armature, and being routed by way of said free side into said clamping gap and, as a result of said piezo actuator being actuated, is held in said clamping gap in a force-fitting manner; and a lever transmission device for converting a force stroke, which is generated by said piezo actuator as a result of being actuated, into a clamping stroke for fixing said tension element, which is held on a hinged armature side and/or on a moving contact side, in a releasable and clamped manner.

2. The electromagnetic relay according to claim 1, wherein said magnet yoke has a clamping lever which pivots about a rotation or rotation point, a lever arm which is acted on by said piezo actuator, and a clamping arm which is routed to said clamping gap.

3. The electromagnetic relay according to claim 2, wherein:

said magnet yoke has a radial slot formed therein; and said clamping lever is produced by said radial slot in said magnet yoke, and said clamping lever is formed by a material web which represents said rotation point.

4. The electromagnetic relay according to claim 2, wherein said clamping arm is longer than said lever arm.

5. The electromagnetic relay according to claim 2, wherein said tension element is oriented axially, and said clamping gap is oriented radially, in relation to said relay coil.

6. The electromagnetic relay according to claim 2, wherein said magnet yoke has a supporting limb which is spaced apart from said clamping lever and on which said piezo actuator, which operates said clamping lever as a result of being actuated, is supported.

7. The electromagnetic relay according to claim 6, wherein a distance between said clamping lever and said supporting limb is matched to an actuator height which runs in a stroke direction of said piezo actuator.

8. An electromagnetic relay, comprising:

a relay coil;

a moving contact;

a first fixed contact;

a hinged armature being pivotable about a rotation axis and on which said moving contact being held relative to at least said first fixed contact;

an L-shaped magnet yoke containing, in relation to said relay coil, a radial pole limb and an axial functional limb to which said hinged armature is connected in an articulated manner by means of said rotation axis;

a piezo actuator which, as a result of being actuated, keeps said moving contact closed when said relay coil is de-energized;

said radial pole limb having a supporting limb and a clamping limb; and said axial functional limb having a U-shaped receiving pocket for said piezo actuator, wherein said U-shaped receiving pocket has U-limbs, which are parallel to one another, merge with said clamping limb and, respectively, with said supporting limb of said radial pole limb.

9. The electromagnetic relay according to claim 2, wherein:

said clamping lever has a clamping cam;

said magnet yoke has a bead-shaped clamping groove formed therein; and said clamping gap is formed between said clamping cam and said bead-shaped clamping groove, said clamping cam engaging in said bead-shaped clamping groove so as to secure said tension element against pivoting radially outward.

10. The electromagnetic relay according to claim 8, wherein said moving contact is a spring contact for generating a spring return force which acts on said hinged armature.

11. The electromagnetic relay according to claim 10, wherein said spring contact has a generally L-shaped spring element being bent in such a way to have offset spring limbs with one of said offset spring limbs fixed to said axial functional limb of said magnet yoke, and another of said offset spring limbs fixed to said hinged armature.

12. The electromagnetic relay according to claim 1, further comprising:

a non-reactive resistor; and a second fixed contact connected to said non-reactive resistor, said non-reactive resistor connected in parallel with said piezo actuator, so as to form a switchover contact.

13. The electromagnetic relay according to claim 3, wherein said magnet yoke has a pole limb and said clamping lever is formed in said pole limb.

14. The electromagnetic relay according to claim 2, wherein said clamping arm is at least twice as long as said lever arm.

15. The electromagnetic relay according to claim 1, wherein the electromagnetic relay is a motor vehicle relay.

* * * * *